US010236112B2

(12) United States Patent
Jung

(10) Patent No.: US 10,236,112 B2
(45) Date of Patent: Mar. 19, 2019

(54) COIL COMPONENT AND METHOD OF MANUFACTURING THE SAME

(71) Applicant: SAMSUNG ELECTRO-MECHANICS CO., LTD., Suwon-si, Gyeonggi-do (KR)

(72) Inventor: Ji Hyung Jung, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 26 days.

(21) Appl. No.: 15/348,268

(22) Filed: Nov. 10, 2016

(65) Prior Publication Data

US 2017/0207018 A1 Jul. 20, 2017

(30) Foreign Application Priority Data

Jan. 19, 2016 (KR) ..... 10-2016-0006258

(51) Int. Cl.

| | |
|---|---|
| ***H01F 27/29*** | (2006.01) |
| ***H01F 27/28*** | (2006.01) |
| ***H01F 5/00*** | (2006.01) |
| ***H01F 41/04*** | (2006.01) |
| ***H01F 41/10*** | (2006.01) |
| ***H01F 17/00*** | (2006.01) |

(52) U.S. Cl.

CPC ..... *H01F 27/2804* (2013.01); *H01F 5/00* (2013.01); *H01F 17/0013* (2013.01); *H01F 27/29* (2013.01); *H01F 27/292* (2013.01); *H01F 41/041* (2013.01); *H01F 41/042* (2013.01); *H01F 41/10* (2013.01); *H01F 2027/2809* (2013.01)

(58) Field of Classification Search

CPC ..... H01F 5/00; H01F 27/00–27/36
USPC ..... 336/65, 83, 192, 200, 232–234
See application file for complete search history.

(56) References Cited

U.S. PATENT DOCUMENTS

| | | | | |
|---|---|---|---|---|
| 8,810,350 | B2 * | 8/2014 | Seko | H01F 17/0013 336/192 |
| 9,911,529 | B2 * | 3/2018 | Sasaki | H01F 27/2804 |
| 2008/0257488 | A1 | 10/2008 | Yamano | |
| 2009/0153282 | A1 * | 6/2009 | Taoka | H01F 17/0013 336/200 |
| 2012/0274432 | A1 | 11/2012 | Jeong et al. | |

FOREIGN PATENT DOCUMENTS

| | | | |
|---|---|---|---|
| JP | 4816971 | B2 | 9/2011 |
| JP | 2013-098356 | A | 5/2013 |
| KR | 10-2012-0122589 | A | 11/2012 |
| KR | 10-2015-0009391 | A | 1/2015 |

OTHER PUBLICATIONS

Korean Office Action dated Apr. 19, 2017, issued in Korean Patent Application No. 10-2016-0006258. (w/ partial English translation).

* cited by examiner

*Primary Examiner* — Tuyen Nguyen
(74) *Attorney, Agent, or Firm* — Morgan Lewis & Bockius LLP

(57) ABSTRACT

A coil component includes a body including a plurality of dielectric layers that are stacked and a plurality of conductor patterns formed on respective dielectric layers and connected to each other by conductive vias, and external electrodes connected to end portions of the plurality of conductor patterns. At least portions of the external electrodes are recessed in the body.

8 Claims, 16 Drawing Sheets

COIL COMPONENT AND METHOD OF MANUFACTURING THE SAME

CROSS-REFERENCE TO RELATED APPLICATION(S)

This application claims benefit of priority to Korean Patent Application No. 10-2016-0006258 filed on Jan. 19, 2016 in the Korean Intellectual Property Office, the disclosure of which is incorporated herein by reference in its entirety.

TECHNICAL FIELD

The present disclosure relates to a coil component and a method of manufacturing the same.

BACKGROUND

An inductor, a coil component, is a representative passive element constituting an electronic circuit, together with a resistor and a capacitor, to remove noise therefrom.

Among coil components, inductors are manufactured by forming a coil part in a body and then forming external electrodes, connected to the coil part, on outer surfaces of the body.

Recently, in accordance with changes such as increased complexity, multifunctionalization, and slimming of a set, attempts to further decrease inductor thickness have been continuously undertaken. Therefore, a scheme allowing high performance and reliability to be secured in an inductor, in spite of the trend for slimming of inductors in the related art, has been demanded.

SUMMARY

An aspect of the present disclosure may provide a coil component having increased inductance through an increase in a volume of a body, and a method of manufacturing the same.

According to an aspect of the present disclosure, a coil component having a structure in which at least portions of external electrodes are recessed in a body, and a method of manufacturing the same may be provided.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Hereinafter, a coil component according to an exemplary embodiment in the present disclosure, particularly, a multilayer inductor, will be described. However, the coil component according to the exemplary embodiment is not necessarily limited thereto.

Figure 1:
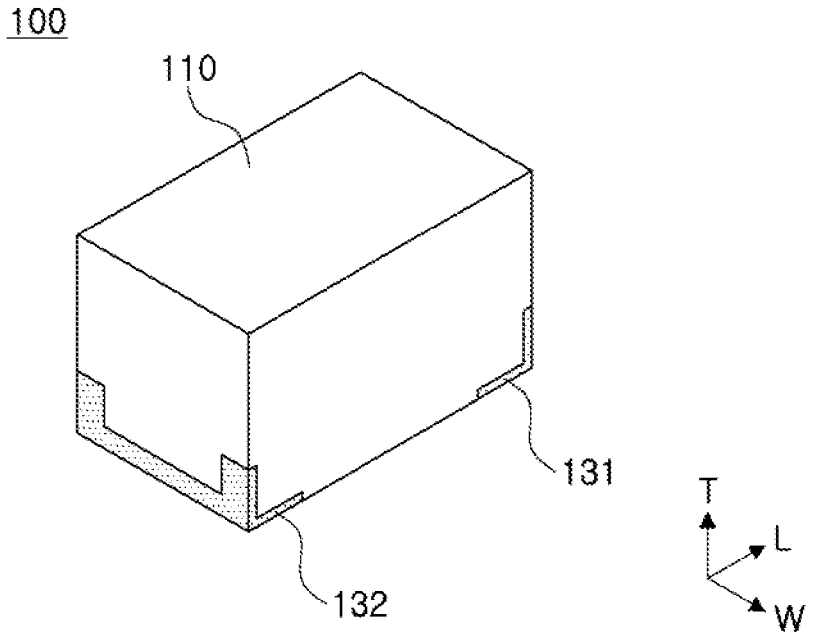
FIG. 1 is a perspective view illustrating a coil component according to an exemplary embodiment in the present disclosure.
Figure 2:
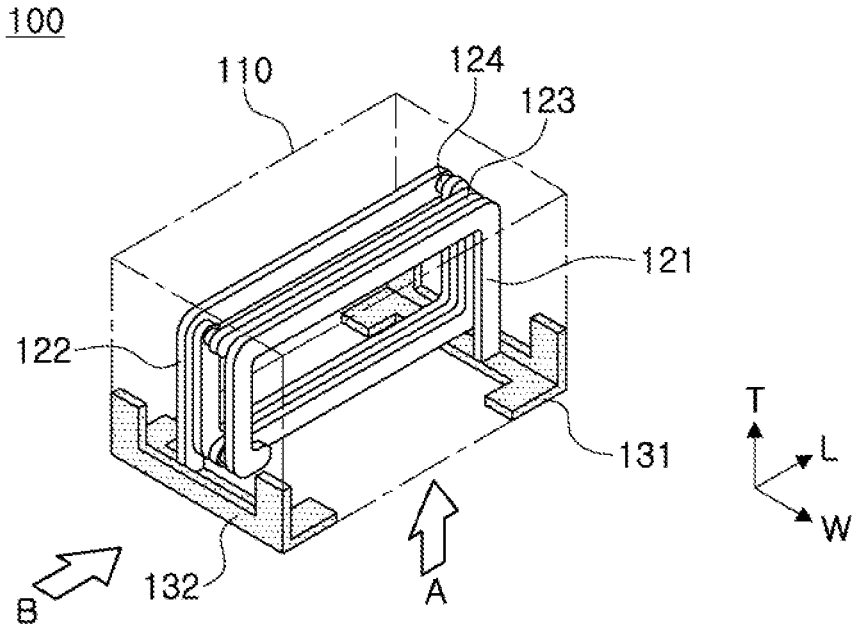
FIG. 2 is a perspective view illustrating the coil component according to an exemplary embodiment in the present disclosure so that conductor patterns of the coil component are visible.
Figure 3:
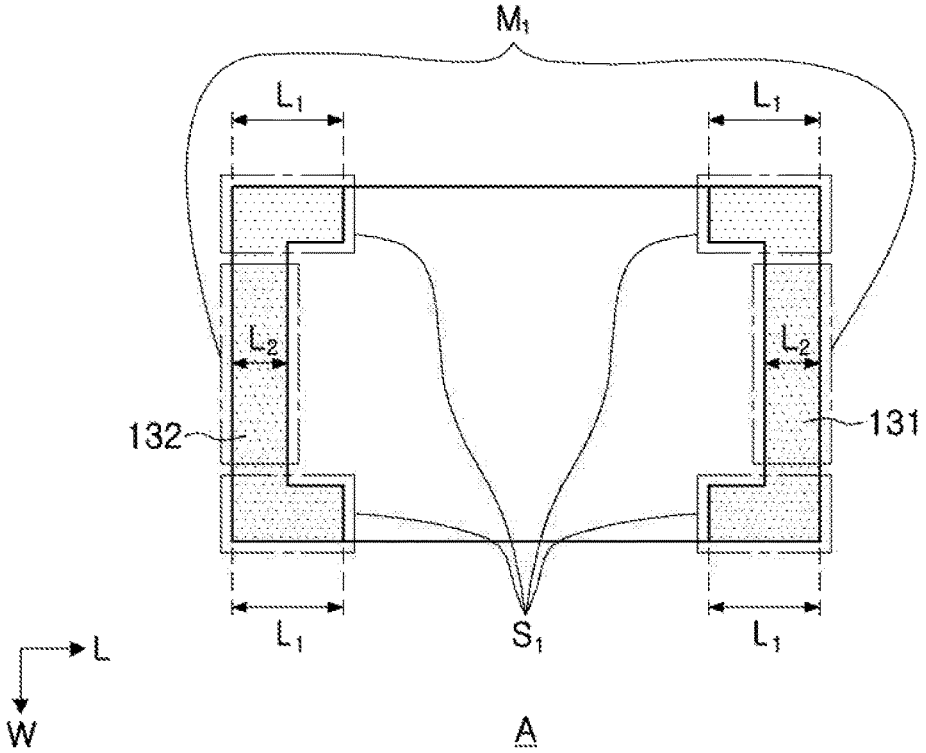
FIG. 3 is schematic side view of the coil component viewed in direction A and direction B in FIG. 2.
Figure 3:
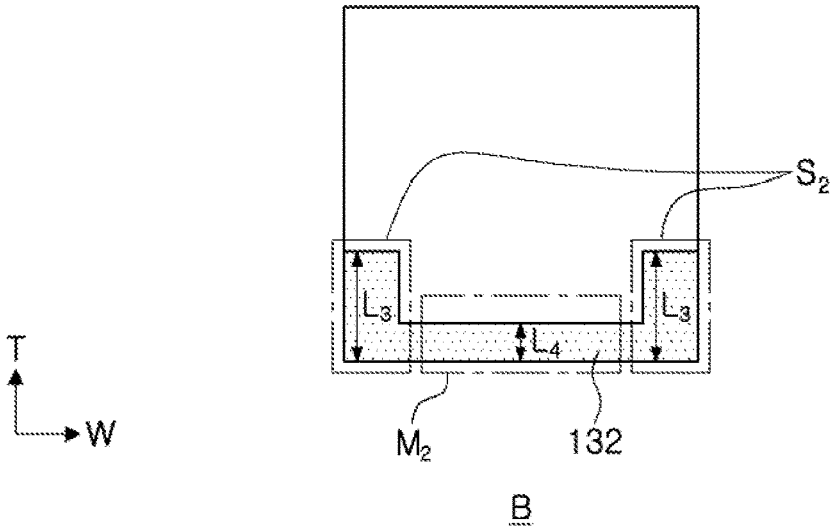
Figure 4:
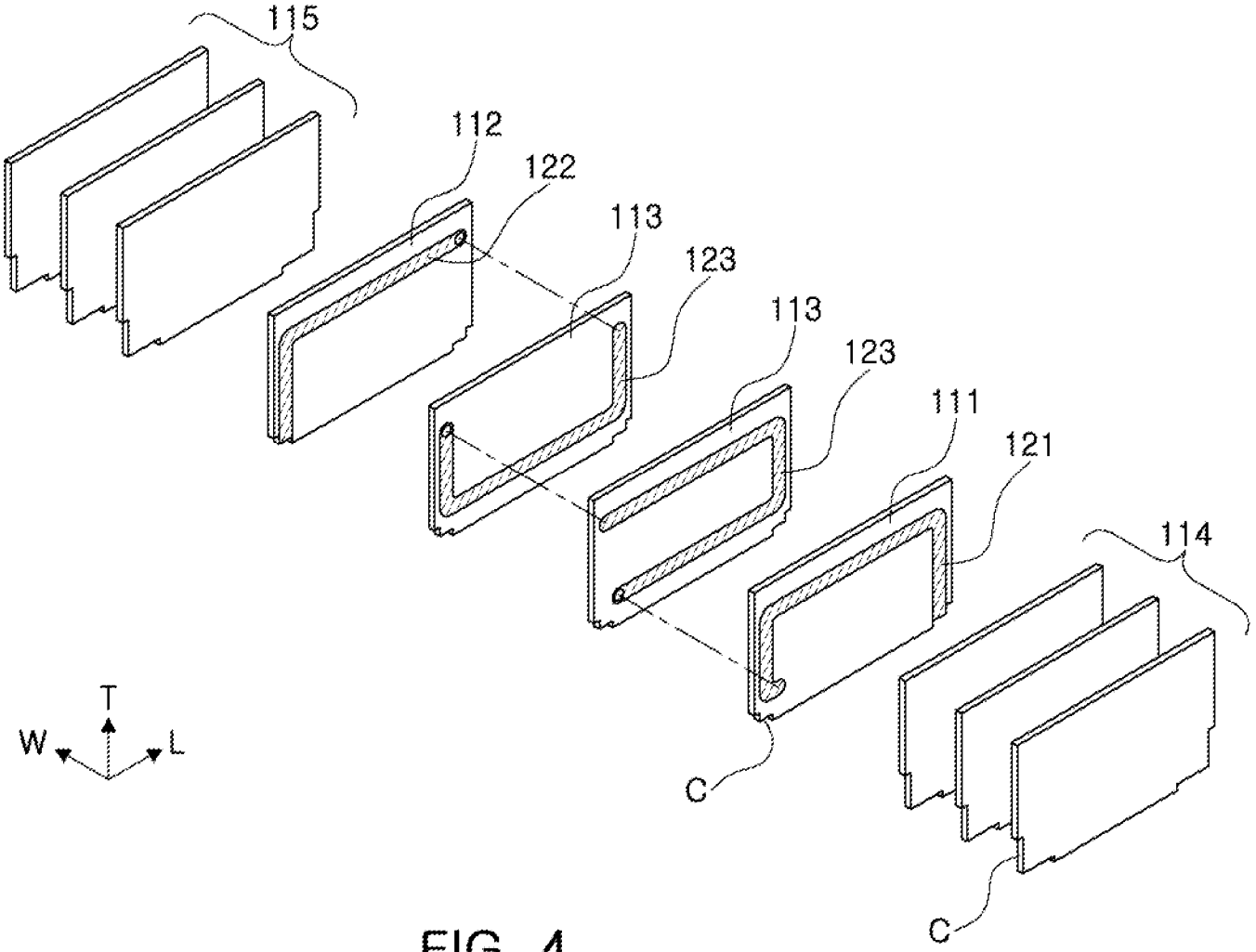
FIG. 4 is an exploded perspective view illustrating a structure in which dielectric layers and conductor patterns of the coil component according to an exemplary embodiment in the present disclosure are formed.
Figure 5:
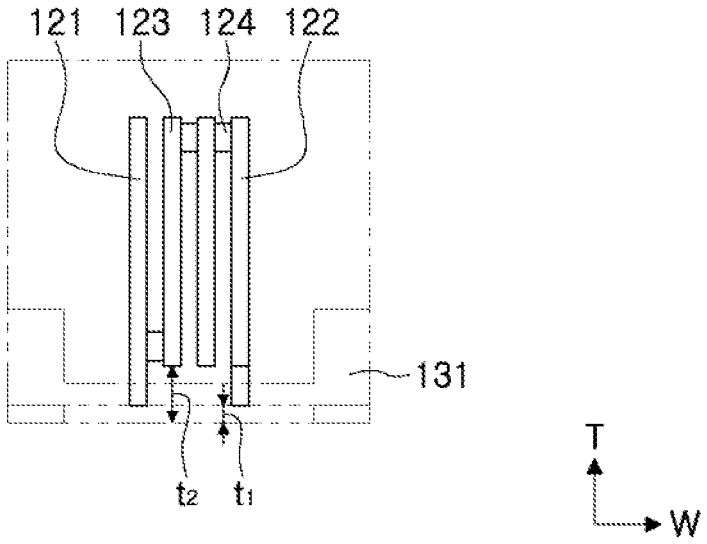
FIG. 5 is a side view illustrating the coil component according to an exemplary embodiment in the present disclosure so that the conductor patterns of the coil component are visible.

FIG. 1 is a perspective view illustrating a coil component according to an exemplary embodiment in the present disclosure, FIG. 2 is a perspective view illustrating the coil component according to an exemplary embodiment in the present disclosure so that conductor patterns of the coil component are visible, FIG. 3 is schematic side view of the coil component viewed in direction A and direction B of FIG. 2, FIG. 4 is an exploded perspective view illustrating a structure in which dielectric layers and conductor patterns of the coil component according to an exemplary embodiment in the present disclosure are formed, and FIG. 5 is a side view illustrating the coil component according to an exemplary embodiment in the present disclosure so that the conductor patterns of the coil component are visible.

Referring to FIGS. 1 through 5, a coil component 100 according to an exemplary embodiment in the present disclosure may include a body 110 and first and second external electrodes 131 and 132.

In the following description described with reference to FIG. 1, a 'length' direction refers to an 'L' direction of FIG. 1, a 'width' direction refers to a 'W' direction of FIG. 1, and a 'thickness' direction refers to a 'T' direction of FIG. 1.

The body 110 may be formed by stacking a plurality of dielectric layers 111 to 113 in the width direction and then sintering the plurality of dielectric layers 111 to 113. A shape and dimensions of the body 110 and the number of stacked dielectric layers 111 to 113 are not limited to those of an example illustrated in the present exemplary embodiment.

In addition, the plurality of dielectric layers 111 to 113 constituting the body 110 may be stacked using a hardening process. In this case, boundaries between the plurality of dielectric layers 111 to 113 may be not readily apparent or may be apparent to the naked eye. However, the plurality of dielectric layers 111 to 113 are not limited thereto.

The dielectric layers 111 to 113 may be sheets manufactured using a dielectric material or a magnetic material, and may be manufactured as thin dielectric sheets by mixing dielectric material powder particles or ceramic magnetic material powder particles such as ferrite, or the like, with a solvent together with a binder, or the like, uniformly dispersing the dielectric material powder particles or the ceramic magnetic material powder particles within the solvent through ball milling, or the like, and then performing a method such as a doctor blade method, or the like.

According to an example, the dielectric layer may contain a photosensitive dielectric material. In this case, a groove part C may be easily formed by exposure and development.

In addition, one or more cover layers 114 and 115 may be formed at the outmost portions of the body 110 in the width direction, respectively.

The cover layers 114 and 115 may be formed of the same material as that of the dielectric layers 111 to 113 and have the same configuration as that of the dielectric layers 111 to 113 except that they do not include conductor patterns.

The cover layers 114 and 115 may basically serve to prevent damage to conductor patterns 121 to 123 due to physical or chemical stress.

A plurality of conductor patterns 121 to 123 may be formed on the plurality of dielectric layers 111 to 113. The plurality of conductor patterns 121 to 123 may be connected to each other in the width direction of the body through conductive vias 124 to constitute a coil implementing inductance. The conductive vias 124 may also be formed by, for example, a method of sequentially plating a plurality of conductive metals in the plurality of dielectric layers 111 to 113.

In addition, a conductive metal used for plating for forming the conductor patterns 121 to 123 may be one selected from the group consisting of silver (Ag), palladium (Pd), platinum (Pt), nickel (Ni), titanium (Ti), tin (Sn), and copper (Cu), or an alloy thereof. However, the conductive metal is not limited thereto.

In addition, a plating method may be electroplating, electroless plating, sputtering, or the like, but is not limited thereto.

Thicknesses and the number of conductor patterns 121 to 123 may be variously determined depending on electrical characteristics of the coil component 100 such as an inductance value required in the coil component 100, or the like The conductor patterns 121 to 123 may be formed in a loop shape along circumferences of the dielectric layers 111 to 113 in order to increase inductance. Preferably, the conductor patterns 121 to 123 may be formed in a shape as similar as possible to the loop shape along the circumferences of the dielectric layers 111 to 113.

Both end portions of the plurality of conductor patterns 121 to 123 connected to each other through the conductive vias 124 may be respectively exposed to positions spaced apart from each other on a first surface of the body 110 to thereby be respectively connected to the first and second external electrodes 131 and 132.

Here, both end portions of the plurality of conductor patterns 121 to 123 exposed to the first surface of the body may be formed at the same width as that of the plurality of conductor patterns 121 to 123 in the body 110. Alternatively, both end portions of the plurality of conductor patterns 121 to 123 exposed to the first surface of the body may be formed at a width greater than that of the conductor patterns 121 to 123 in the body 110, if necessary, whereby electrical connectivity between the conductor patterns and the external electrodes 131 and 132 may be increased.

Here, the first surface of the body 110 to which both end portions of the plurality of conductor patterns 121 to 123 are exposed may be a mounting surface on which the coil component 100 is mounted.

The first and second external electrodes 131 and 132 may be respectively connected to both end portions of the plurality of conductor patterns 121 to 123 connected to each other through the conductive vias 124.

Generally, the external electrodes occupy dimensions of the coil component. That is, with a predetermined size, due to thicknesses of the external electrodes themselves, a volume of the body is decreased by the thicknesses of the external electrodes.

Therefore, in an exemplary embodiment in the present disclosure, at least portions of the first and second external electrodes 131 and 132 may be recessed in the body 110, whereby a volume of the body is significantly increased. In this case, an area of a dielectric body for implementing inductance of the coil component may be increased, such that inductance of the coil component may be increased and a process degree of freedom that may satisfy dimensional tolerance of a final product may also be increased.

According to an example, surfaces of the first and second external electrodes 131 and 132 may be coplanar with surfaces of the body 110. As described above, in a case in which the first and second external electrodes 131 and 132 are formed without having step portions between the first and second external electrodes 131 and 132 and the body 110, the inductance may be significantly increased through a significant increase in a volume of the body.

Referring to FIG. 4, groove parts C having shapes corresponding to those of the first and second external electrodes 131 and 132 may be formed in outer surfaces of the body 110 in order for at least portions of the first and second external electrodes 131 and 132 to be recessed in the body 110.

A method of forming the groove parts C in the outer surfaces of the body 110 is not particularly limited. For example, the groove parts C may be formed in the outer surfaces of the body 110 by preparing dielectric layers containing a photosensitive dielectric material and cover layers, removing regions in which the groove parts C will be formed through exposure and development in each of the dielectric layers and the cover layers, and then stacking and sintering the dielectric layers and the cover layers in which the regions are removed.

According to an example, the first and second external electrodes 131 and 132 may be formed on the first surface to be spaced apart from each other, and may be connected to both end portions of the plurality of conductor patterns, respectively.

According to an example, the first external electrode 131 may extend to a second surface of the body 110 connected to the first surface of the body 110, and the second external electrode 132 may extend to a third surface of the body 110 connected to the first surface of the body 110. The second and third surfaces may be opposite surfaces of the body 110 in a length direction thereof and connected by the first surface.

In this case, in a case of mounting the coil component 100 on a board using a solder, the solder may also contact side surfaces of the body 110, such that the coil component 100 may be stably mounted on the board and occurrence of damage due to deformation of the board may be significantly decreased to improve reliability.

According to an example, respective portions of the first and second external electrodes 131 and 132 formed on the first surface of the body 110 and portions of the first and second external electrodes 131 and 132 formed on the second surface or the third surface of the body 110 may have side portions and a central portion, and the side portions may have a length longer than that of the central portion.

For example, a length $L_1$ in the length direction of side portions $S_1$ of the first and second external electrodes 131 and 132 formed on the first surface of the body 110 may be longer than a length $L_2$ in the length direction of central portions $M_1$ of the first and second external electrodes 131 and 132 formed on the first surface of the body 110.

In addition, a length $L_3$ in the thickness direction of side portions $S_2$ of the first and second external electrodes 131 and 132 formed on the second surface or the third surface of the body 110 may be longer than a length $L_4$ in the thickness direction of central portions $M_2$ of the first and second external electrodes 131 and 132 formed on the second surface or the third surface of the body 110.

In this case, the coil component 100 may be stably mounted, and a parasitic capacitance generated between the conductor patterns 121 to 123 and the external electrodes 131 and 132 may be decreased, such that a quality (Q) factor of the coil component 100 may be improved.

In addition, according to an example, conductor patterns may not be formed on dielectric layers directly contacting the side portions of the first and second external electrodes 131 and 132. Further, according to an example, a length $t_1$ in the thickness direction of the central portions of the first and second external electrodes 131 and 132 formed on the second surface or the third surface of the body 110 may be shorter than a distance $t_2$ in the thickness direction between portions of the plurality of conductor patterns 121 to 123 except both end portions of the plurality of conductor patterns 121 to 123 and the first surface of the body 110.

In this case, a parasitic capacitance generated between the conductor patterns 121 to 123 and the external electrodes 131 and 132 may be significantly decreased, such that a Q factor of the coil component 100 may be improved.

The first and second external electrodes 131 and 132 may be plating electrodes formed by plating. In a case in which the external electrodes are formed by direct plating as described above, a thickness of the external electrodes may be easily adjusted, the external electrodes may be formed at a thinner thickness, and a volume of the body 110 may be further increased. Therefore, inductance, direct current (DC) bias characteristics, efficiency, and the like, of the coil component may be improved.

The first and second external electrodes 131 and 132 may be formed of a conductive material, for example, silver (Ag), palladium (Pd), aluminum (Al), nickel (Ni), titanium (Ti), gold (Au), copper (Cu), platinum (Pt), alloys thereof, or the like.

In a case in which the first and second external electrodes 131 and 132 are the plating electrodes formed by plating, the first and second external electrodes 131 and 132 may not contain a glass component and a resin.

FIGS. 6 through 9C are schematic views illustrating examples of processes of manufacturing a coil component according to an exemplary embodiment in the present disclosure.

Hereinafter, a manufacturing a coil component according to an exemplary embodiment in the present disclosure will be described, but a description of contents overlapped with the contents described above will be omitted.

Figure 6:
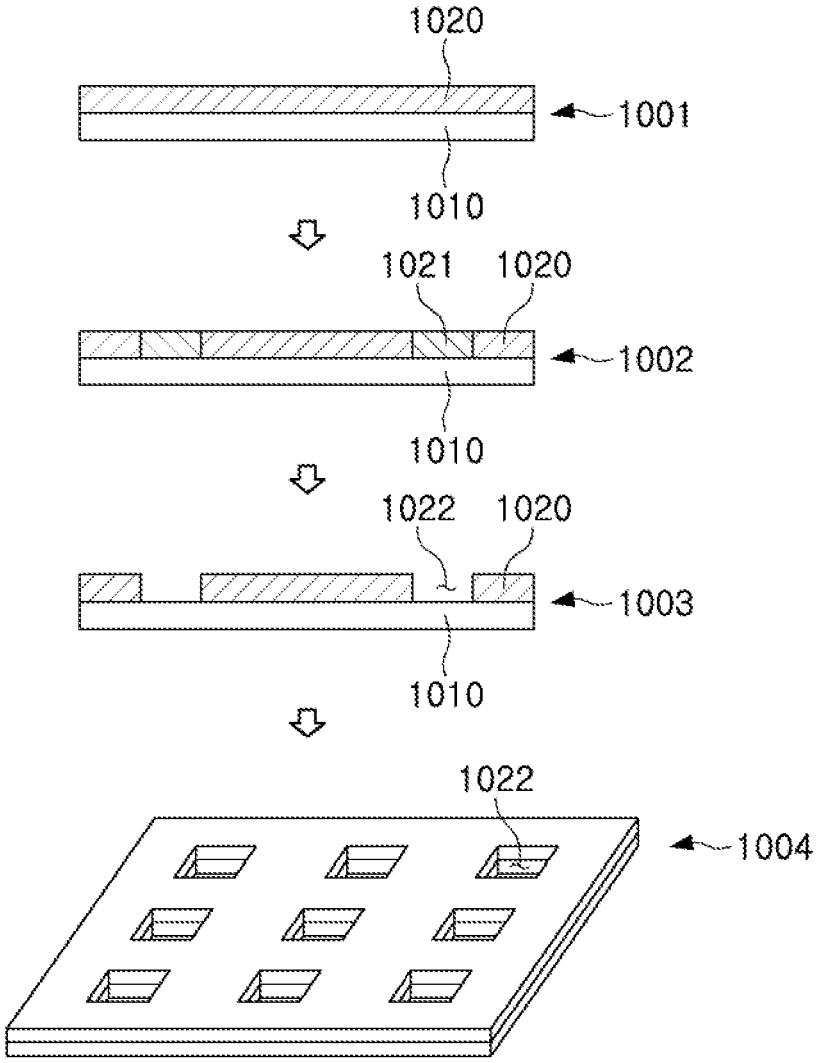
FIGS. 6 through 8D are schematic views illustrating examples of processes of manufacturing a coil component according to an exemplary embodiment in the present disclosure.

FIG. 6 schematically illustrates an example of manufacturing processes of forming a dielectric cover layer.

Referring to process 1001, a dielectric layer 1020 containing a photosensitive dielectric material may be stacked on a carrier film 1010. The carrier film 1010 may be used in order to easily handle the dielectric layer 1020 and protect the dielectric layer 1020. The carrier film 1010 may be a member formed of a resin such as polyethylene terephthalate (PET), polyethylene-naphthalate (PEN), polycarbonate (PC), or the like, and having a thickness of about 10 μm to 200 μm, but is not limited thereto. The carrier film 1010 needs to be easily detached in a removal process while having adhesive properties. To this end, a high temperature foaming type adhesive, an ultraviolet (UV) curable adhesive, or the like, may be used to adjust attachment and detachment of the carrier film 1010. The dielectric layer 1020 may be formed of a thermosetting resin having a semi-hardened state. The dielectric layer 1020 may be formed of, for example, a Bismaleimide Triazine (BT) resin. The dielectric layer 1020 may be formed on the carrier film 1010 by a known lamination process. In this case, the dielectric layer 1020 may be in a semi-hardened state, and a thermosetting resin may be used as a material of the dielectric layer 1020 in order to implement the semi-hardened state. However, a material of the dielectric layer 1020 is not limited to the thermosetting resin, but may also be any resin having both UV curable properties and/or thermosetting properties.

Referring to process 1002, exposure and development 1021 for forming electrode holes 1022 may be performed on the dielectric layer 1020 using a known photolithography method. For example, the dielectric layer 1020 may be directly exposed in shapes of the electrode holes 1022 using a UV laser beam and then developed, such that the shapes of the electrode holes 1022 may be engraved in the dielectric layer 1020.

Referring to process 1003, the electrode holes 1022 that will be used subsequently to form external electrodes may be formed in the dielectric layer 1020 as a result of the exposure and the development. As a result, a dielectric cover layer 1020 in which the electrode holes 1022 are formed may be manufactured. An inner layer circuit is not particularly formed on the dielectric cover layer 1020, and the dielectric cover layer 1020 may serve to provide the electrode holes for forming the external electrodes therein in a subsequent process and form a product dimension. The dielectric cover layers 1020 need to be stacked on and beneath a laminate formed in a subsequent process. Therefore, a plurality of dielectric cover layers 1020 may be manufactured.

Referring to process 1004, a plurality of electrode holes 1022 may be formed in the dielectric cover layer 1020. Therefore, several coil components may be manufactured through a single process of forming and dicing a laminate, which is a subsequent process.

Figure 7A:
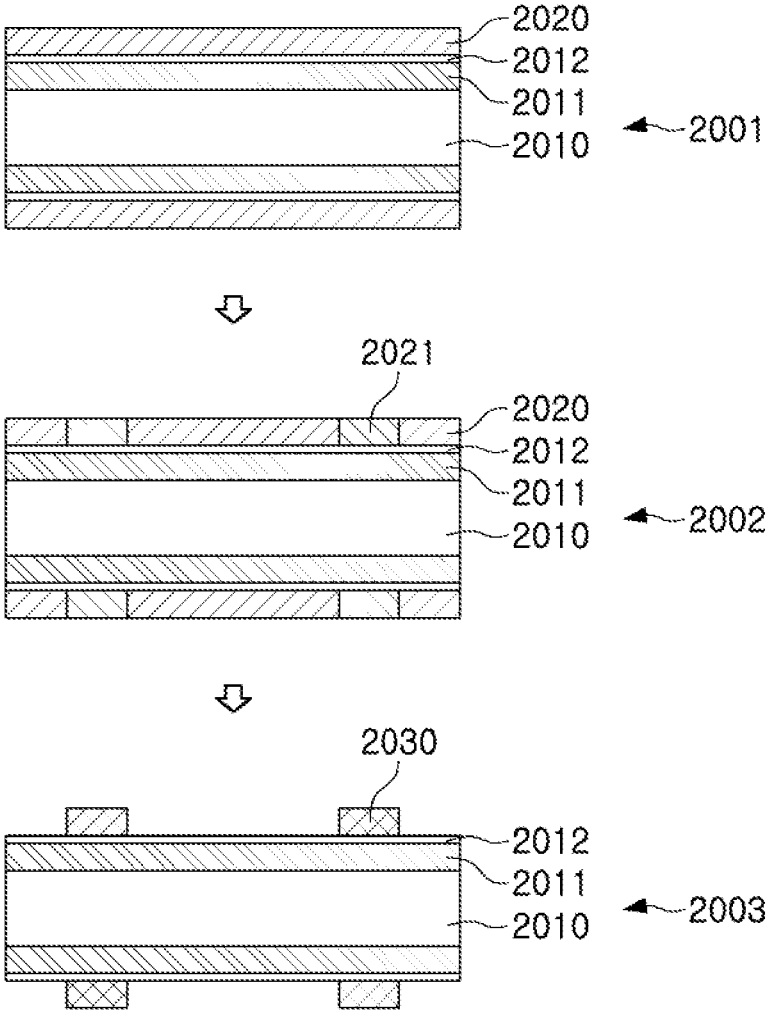
Figure 7B:
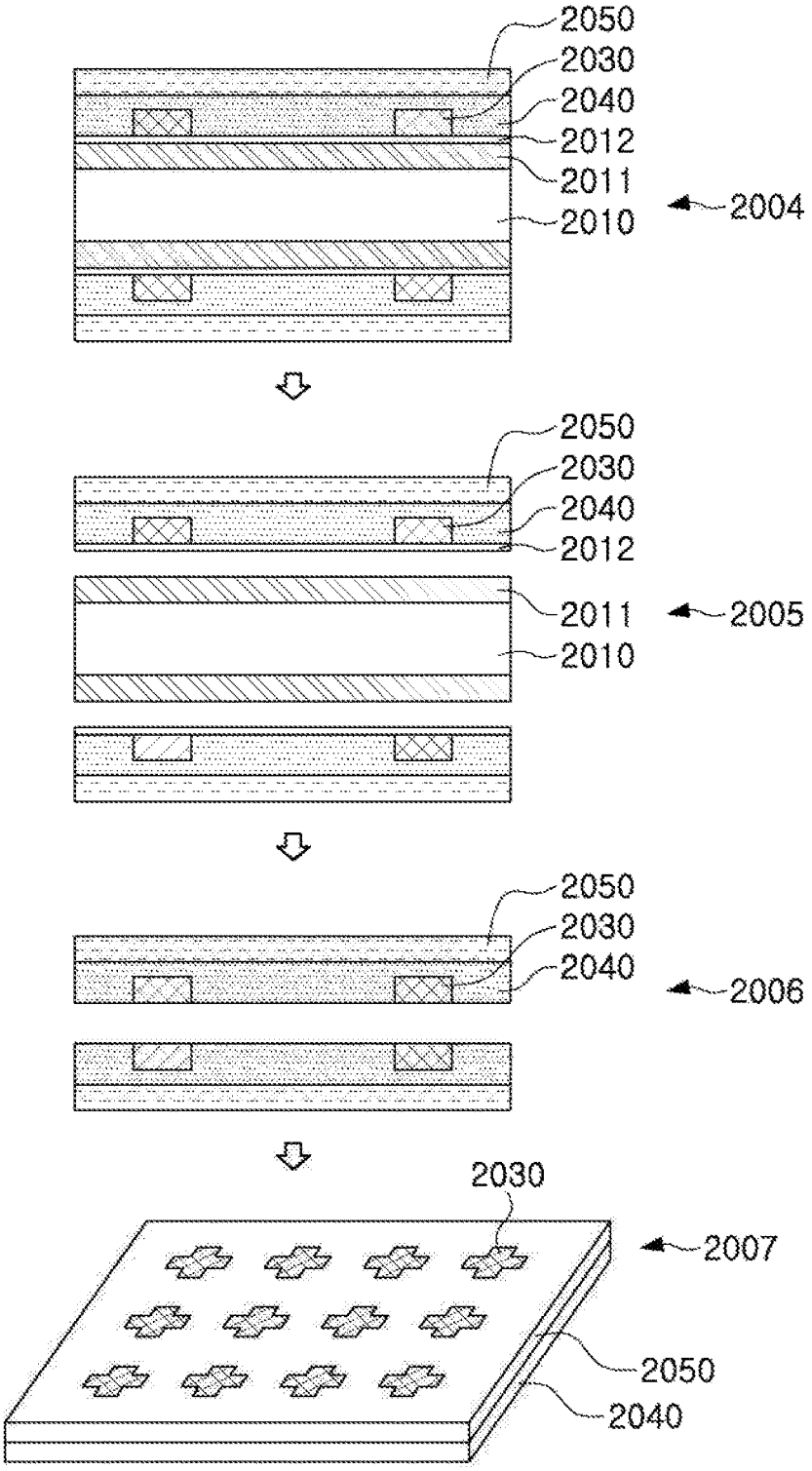
Figure 8A:
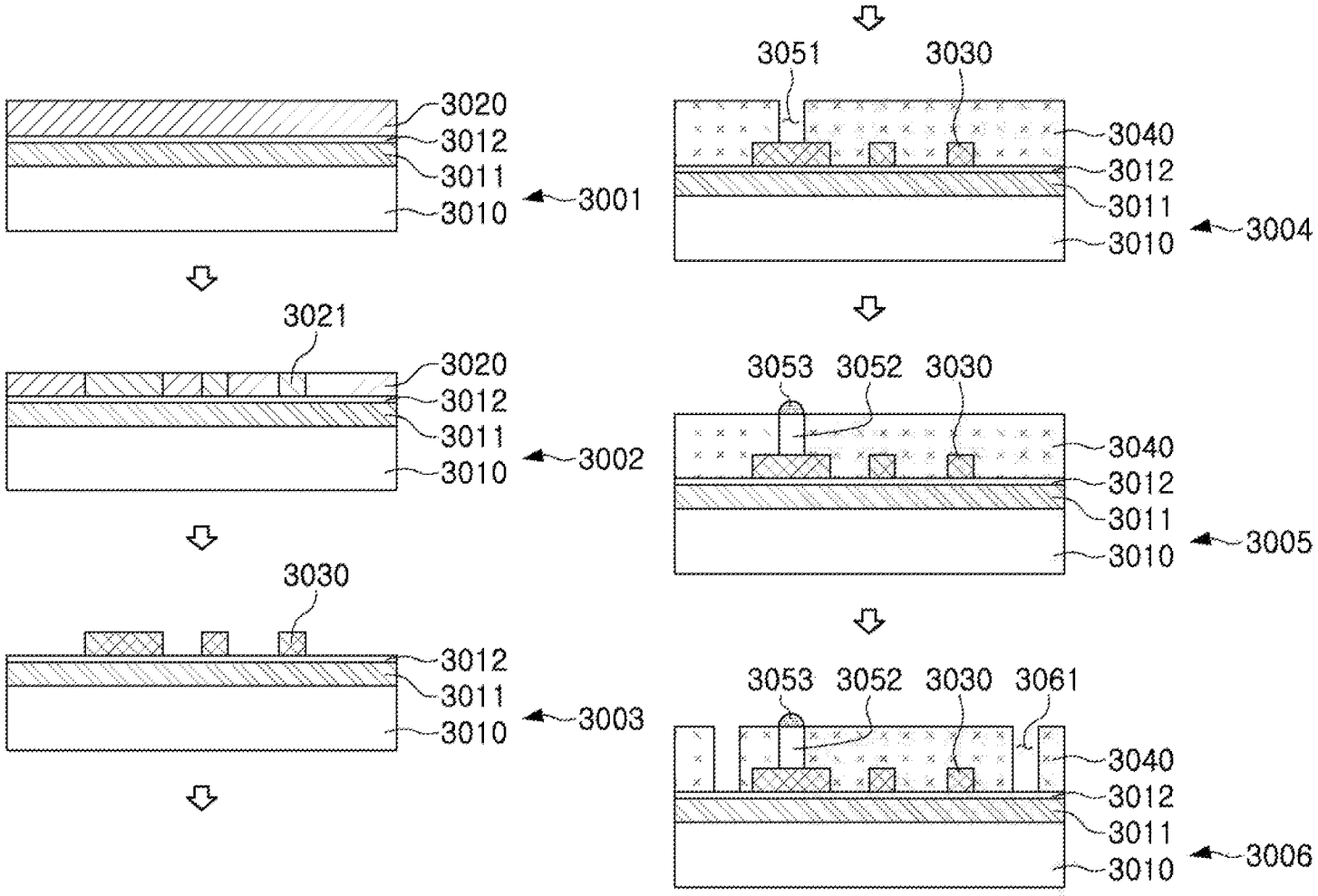
Figure 8B:
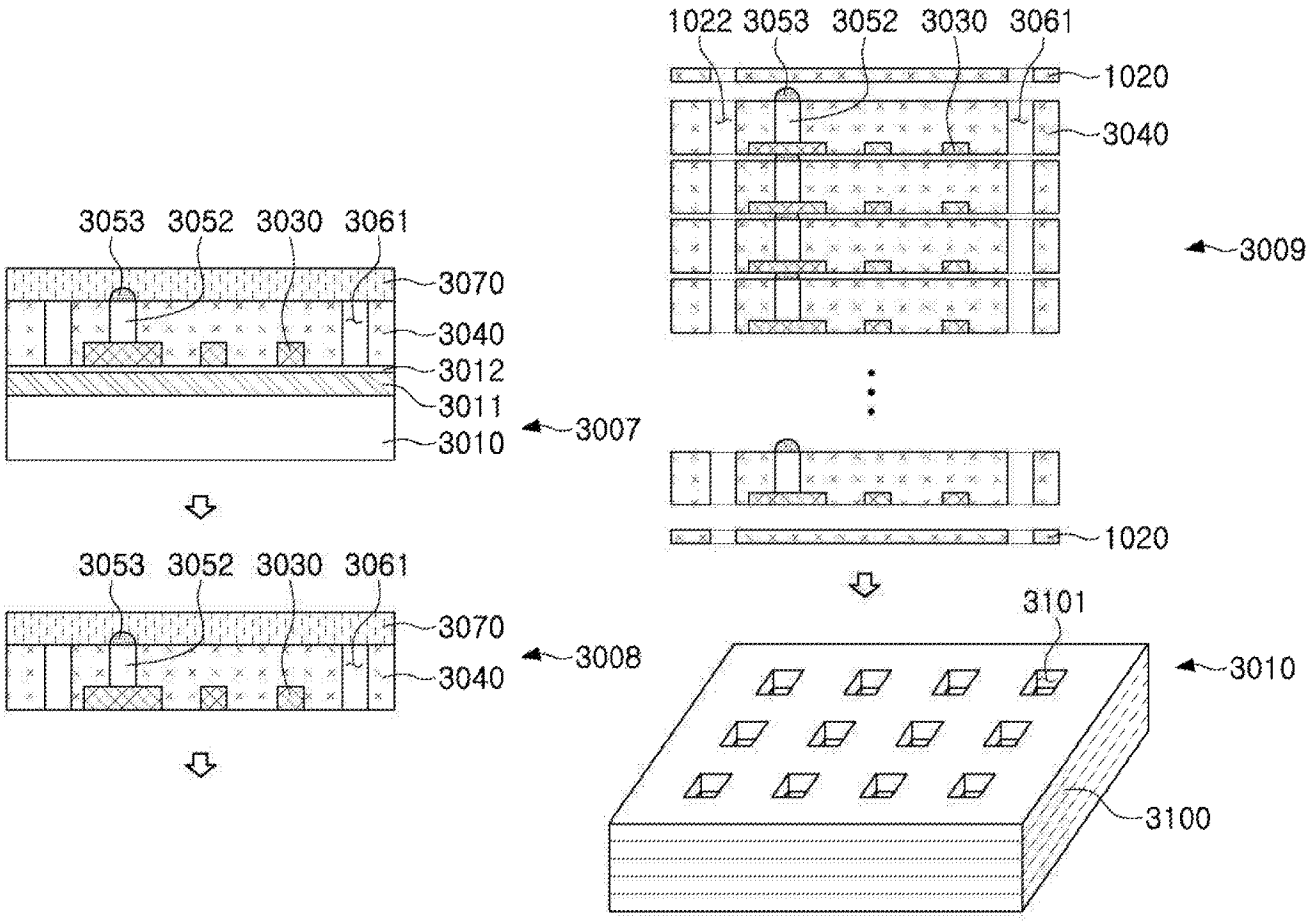
Figure 8C:
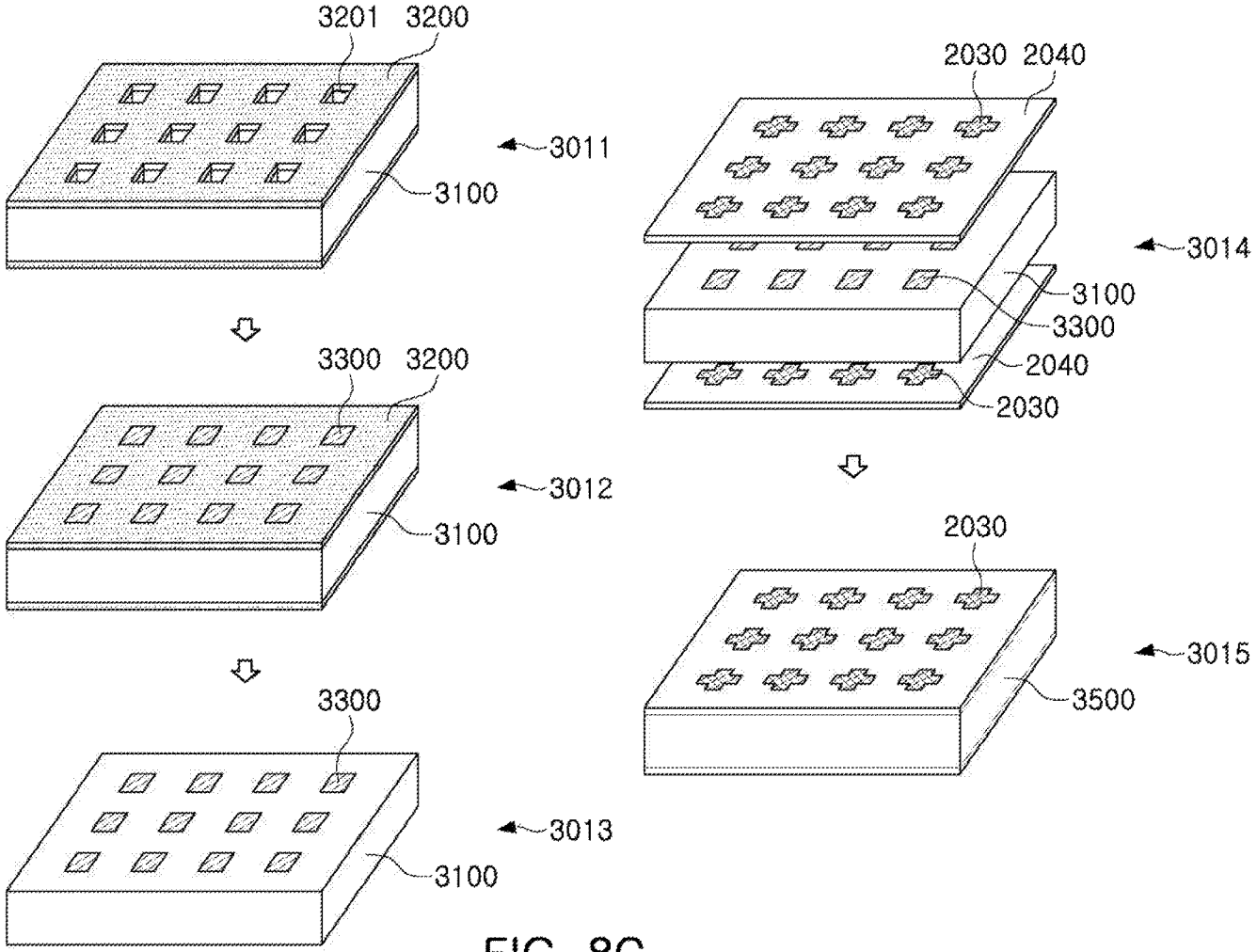
Figure 8D:
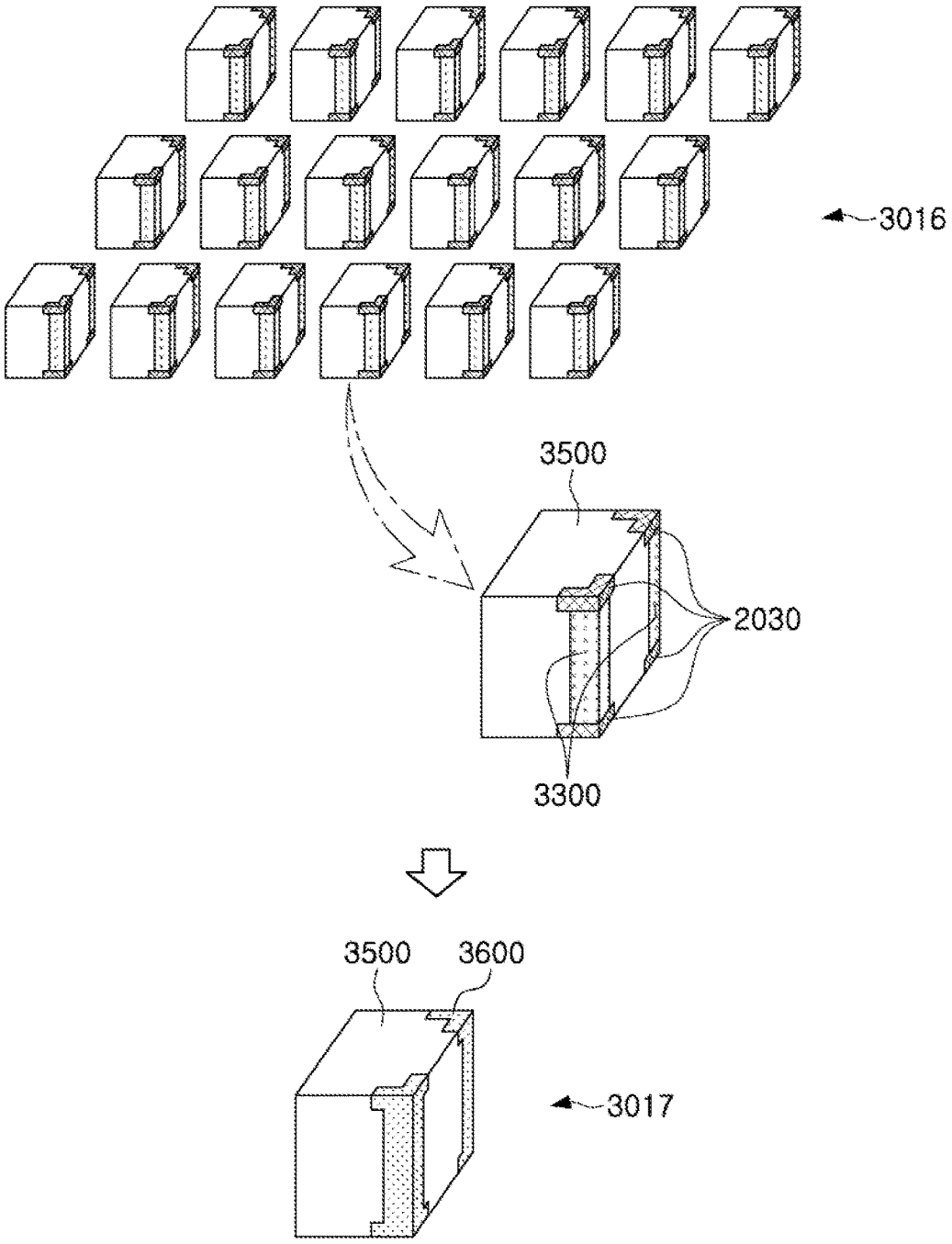

FIGS. 7A and 7B schematically illustrate an example of manufacturing processes of forming a pad dielectric layer.

Referring to process 2001, photosensitive films 2020 may be stacked on a core substrate 2010 having a plurality of metal layers 2011 and 2012 formed on both surfaces thereof. The core substrate 2010 having the plurality of metal layers 2011 and 2012 may be a known copper clad laminate (CCL), for example, formed by attaching copper cladding having a thickness of about 18 μm to both surfaces of a polypropylene glycol (PPG) substrate and forming a seed copper (Cu) layer at a thickness of 5 μm through plating. The photosensitive film 2020 may be a known dry film photo-resist (DFR) film. In this case, a thickness of the DFR film may be about 15 μm to 50 μm. The photosensitive films 2020 may be stacked under a roll lamination condition at a temperature of 120° C. and a pressure of 5 kgf/cm$^2$, but are not limited thereto.

Referring to process 2002, exposure and development 2021 for forming electrode pads 2030 may be performed on the photosensitive films 2020 using a known photolithography method. For example, the photosensitive films 2020 may be directly exposed in shapes of the electrode pads 2030 using a UV laser beam and then developed, such that the shapes of the electrode pads 2030 may be engraved in the photosensitive films 2020.

Referring to process 2003, a conductive material may be filled in holes formed by the exposure and the development using plating, or the like, to form the electrode pads 2030, and the photosensitive films 2020 may be peeled off. The plating may be performed by a known plating method, a plating thickness may be 5 μm to 50 μm, and the metal layers 2012 may be used as seed layers.

Referring to process 2004, dielectric layers 2040 containing a photosensitive dielectric material may be stacked on the electrode pads 2030, and mask films 2050 may be stacked on the dielectric layers 2040. The purpose of the mask film 2050 may be to protect the dielectric layer 2040, and polyethylene terephthalate (PET) having a thickness of 50 μm, or the like, may be used as the mask film 2050.

Referring to process 2005, the core substrate 2010 may be peeled off by separating the plurality of metal layers 2011 and 2012 from each other.

Referring to process 2006, the remaining metal layers 2012 may be removed by a known etching process. As a result, pad dielectric layers 2040 in which the electrode pads 2030 are formed may be manufactured. The pad dielectric layers may be disposed at the outmost portions of a laminate constituting a body in a subsequent process to serve as electrode pads for forming external electrodes. The pad dielectric layers 2040 need also to be stacked on and beneath a laminate formed in a subsequent process. Therefore, a plurality of pad dielectric layers 2040 may be manufactured.

Referring to process 2007, a plurality of electrode pads 2030 may be formed in the pad dielectric layer 2040. Therefore, several coil components may be manufactured by one process through a process of forming and dicing a laminate, which is a subsequent process. The electrode pads 2030 may be formed in an approximately cross (+) shape in the pad dielectric layer 2040, but may have an approximately L shape in terms of the respective coil components after the laminate is diced.

FIGS. 8A through 8D schematically illustrate an example of manufacturing processes of forming a laminate and manufacturing individual coil components using the laminate.

Referring to process 3001, photosensitive films 3020 may be stacked on a core substrate 3010 having a plurality of metal layers 3011 and 3012 formed on both surfaces thereof. The core substrate 3010 having the plurality of metal layers 3011 and 3012 may be a known copper clad laminate (CCL), for example, formed by attaching copper clad having a thickness of about 18 μm onto both surfaces of a polypropylene glycol (PPG) substrate and forming a seed copper (Cu) layer at a thickness of 5 μm through plating. The photosensitive film 3020 may be a known dry film photoresist (DFR) film. In this case, a thickness of the DFR film may be about 15 μm to 50 μm. The photosensitive films 3020 may be stacked under a roll lamination condition at a temperature of 120° C. and a pressure of 5 kgf/cm$^2$, but are not limited thereto.

Referring to process 3002, exposure and development 3021 for forming conductor patterns 3030 may be performed on the photosensitive films 3020 using a known photolithography method. For example, the photosensitive films 3020 may be directly exposed in shapes of the conductor patterns 3030 using a UV laser beam and be then developed, such that the shapes of the coil patterns 3030 may be engraved in the photosensitive films 3020.

Referring to process 3003, a conductive material such as a copper (Cu), or the like, may be filled in holes formed by the exposure and the development using plating, or the like, to form the conductor patterns 3030, and the photosensitive films 3020 may be peeled off. The plating may be performed by a known plating method, a plating thickness may be 5 μm to 50 μm, and the metal layers 3012 may be used as seed layers.

Referring to process 3004, dielectric layers 3040 containing a photosensitive dielectric material may be stacked on the conductor patterns 3030. Via holes 3051 exposing the conductor patterns 3030 may be formed in the dielectric layers 3040. The via holes 3051 may be formed through exposure and development.

Referring to process 3005, a conductive material may be filled in the via holes 3051 to form conductive vias 3052 and 3053. The conductive vias 3052 and 3053 may be formed by a known conductive metal plating process, a known conductive paste printing process, or the like. The conductive vias 3052 and 3053 may include, for example, a copper conductor layer 3052 and a tin conductor layer 3053, but are not limited thereto. The tin conductor layer 3053 may have a small step of about 5 μm from a surface of the dielectric layer 3040.

Referring to process 3006, electrode holes 3061 for forming external electrodes may be formed in the dielectric layers 3040. The electrode holes 3061 may also be formed using exposure and development.

Referring to process 3007, mask films 3070 may be stacked on the dielectric layers 3040 in order to protect the conductor patterns 3030, and the like. In addition, the core substrate 3010 may be peeled off by separating the plurality of metal layers 3011 and 3012 from each other.

Referring to process 3008, the metal layers 3012 may be removed by a known etching process. As a result, the dielectric layers 3040 in which the conductive vias 3052 and 3053, the conductor patterns 3030, and the electrode holes 3061 are formed may be formed.

Referring to process 3009, a plurality of dielectric layers 3040 in which the conductive vias 3052 and 3053, the conductor patterns 3030, and the electrode holes 3061 are formed through a series of processes and a plurality of dielectric cover layers 1020 having electrode holes 1022 may be stacked in a block so that the electrode holes 3061 and 1022 are connected to each other. The mask films 3070 of respective dielectric layers 3040 may be primarily removed, the dielectric layers 3040 may be stacked so that the conductor patterns 3030 of the dielectric layers 3040 are aligned with each other, and the dielectric cover layers 1020 may be stacked on and beneath the dielectric layers 3040 to be aligned with the dielectric layers 3040 and be secondarily compressed at a high temperature. Here, the conductive vias 3052 and 3053 may be formed of a metal oxide of copper (Cu)-tin (Sn).

Referring to process 3010, a laminate 3100 in which a plurality of electrode holes 3101 are formed may be formed as a result of stacking the plurality of dielectric layers 3040 and the plurality of dielectric cover layers 1020 in a block.

Referring to process 3011, photosensitive films 3200 may be stacked on the laminate 3100, and holes 3021 may be formed in the photosensitive films 3200 by exposure and development so that the electrode holes 3010 are opened.

Referring to process 3012, electrode seed layers 3300 for forming external electrodes may be formed on wall surfaces of the electrode holes 3101 of the laminate 3100. The electrode seed layer 3300 may be formed by plating, for example, titanium (ti) and chromium (Cr) by a sputtering method. In some cases, the electrode seed layer may have a multilayer structure of titanium (Ti), chromium (Cr), and nickel (Ni)-chromium (Cr). Alternatively, the electrode seed layer 3300 may be formed by plating, for example, copper (Cu) and Nickel (Ni) by an electroless plating method. In this case, the electrode seed layer may be formed by plating a copper (Cu) layer at a sufficient thickness and plating a nickel (Ni) layer on the copper layer at a sufficient thickness.

Referring to process 3013, the photosensitive films 3200 stacked on the laminate 3100 may be peeled off.

Referring to process 3014, the laminate 3100 and a plurality of pad dielectric layers 2040 on which electrode pads 2030 are formed may be stacked in a block so that the electrode holes 3101 of the laminate 3100 and the electrode pads 2030 of the plurality of pad dielectric layers 2040 are connected to each other. The plurality of pad dielectric layers 2040 may be stacked on and beneath the laminate 3100. A temperature at the time of stacking the plurality of pad dielectric layers 2040 may be about 150° C. to 250° C. In this case, a pressure of 10 to 100 kgf/cm$^2$ may be applied to the plurality of pad dielectric layers 2040.

Referring to process 3015, a laminate 3500 including the plurality of electrode pads 2030 and the plurality of electrode holes 3101 in which the electrode seed layers 3300 are formed may be formed as a result of stacking the laminate 3100 and the plurality of pad dielectric layers 2040 in a block.

Referring to process 3016, the laminate 3500 may be diced using a dicing blade, or the like, to form a plurality of individual bodies.

Referring to process 3017, conductor layers 3500 may be again formed on the electrode pads 2030 and the electrode seed layers 3300 of each of the plurality of individual bodies. As a result, external electrodes 3600 may be formed. The conductor layer 3500 may include a nickel (Ni) layer and a tin (Sn) layer. The conductor layer 3500 may be formed by forming the nickel (Ni) layer by plating and then forming the tin (Sn) layer by plating, but is not limited thereto.

Figure 9A:
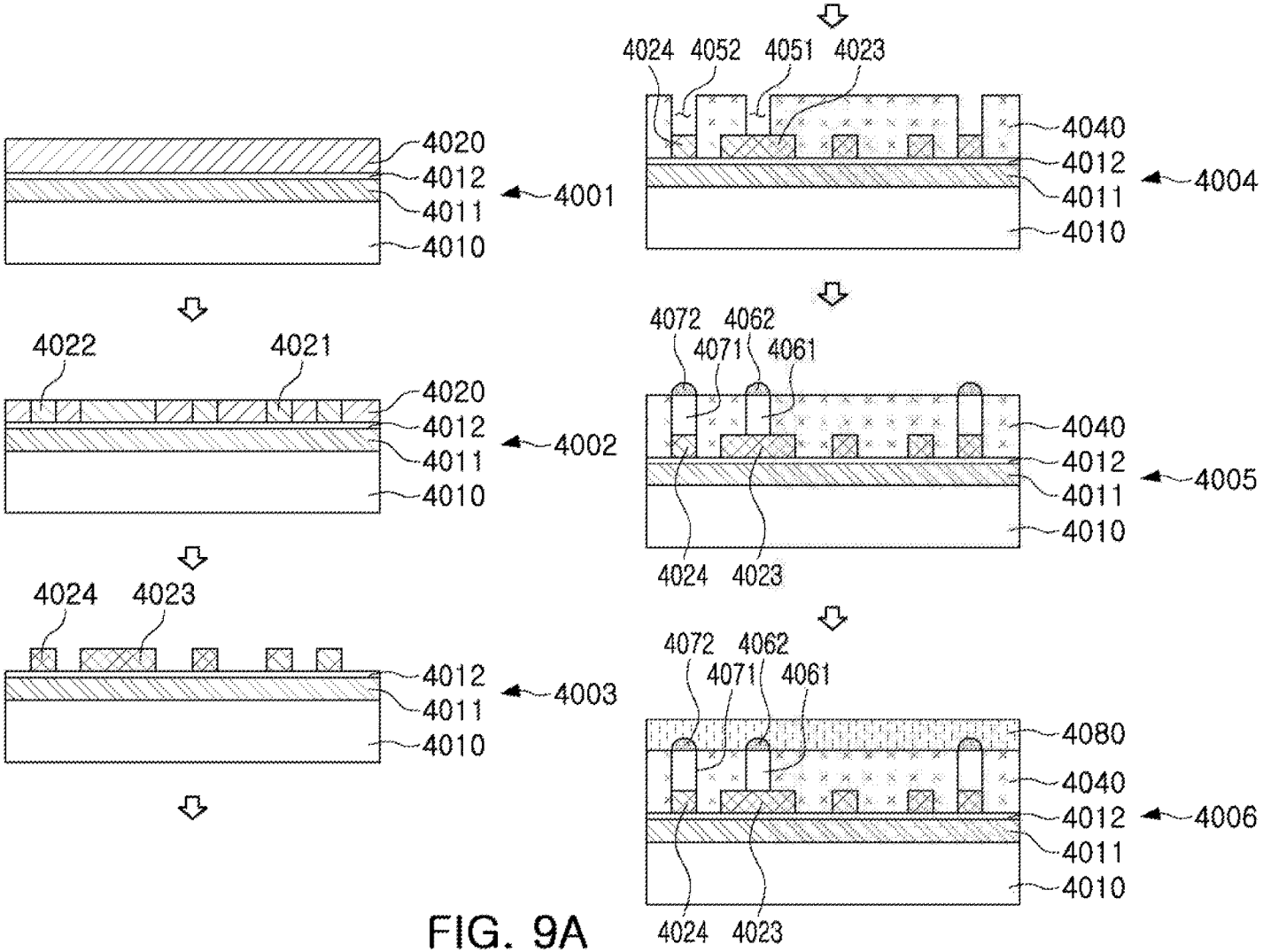
FIGS. 9A through 9C are schematic views schematically illustrating an example of manufacturing processes of forming a laminate and manufacturing individual coil components using the laminate according to another exemplary embodiment in the present disclosure.
Figure 9B:
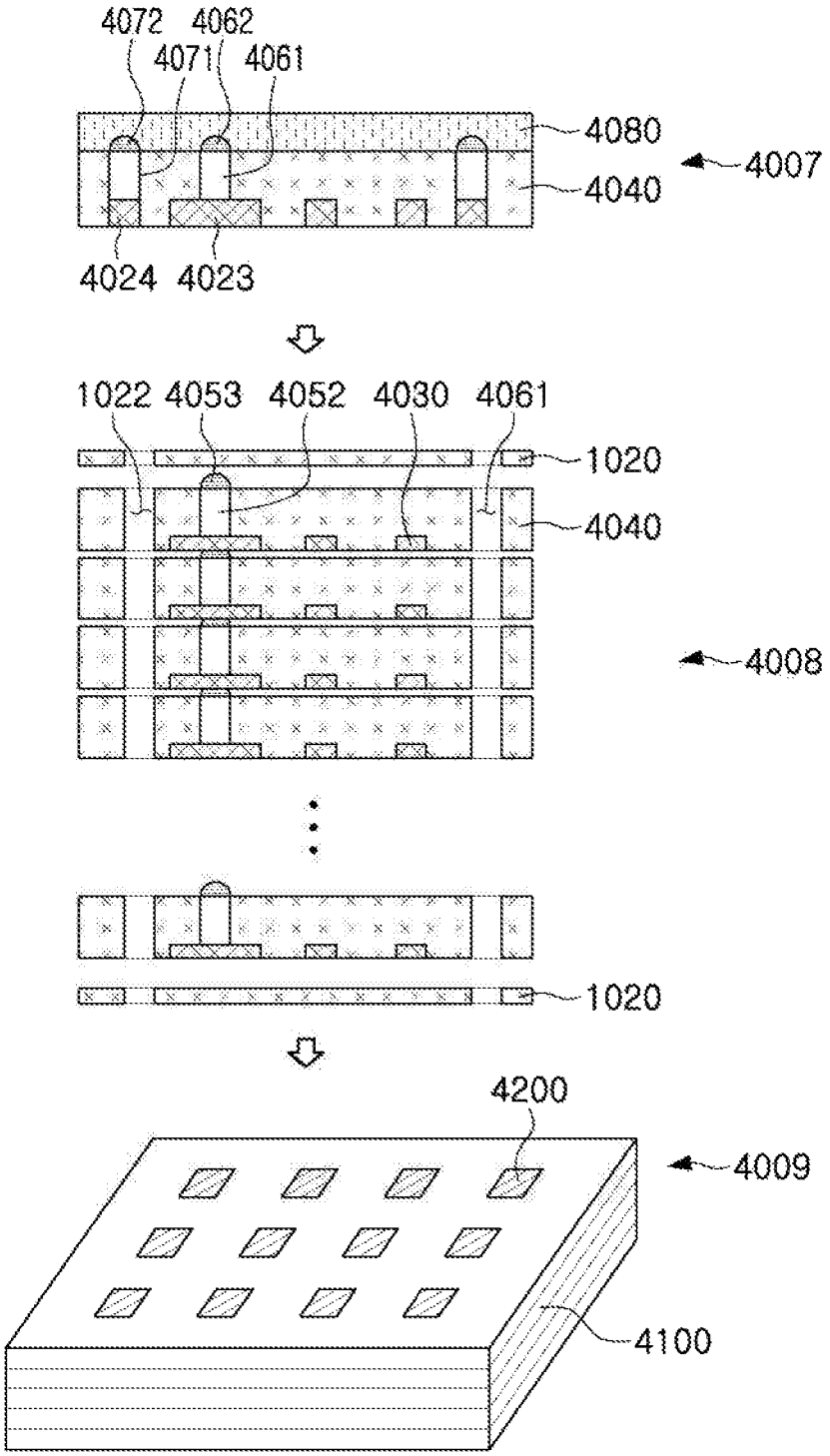
Figure 9C:
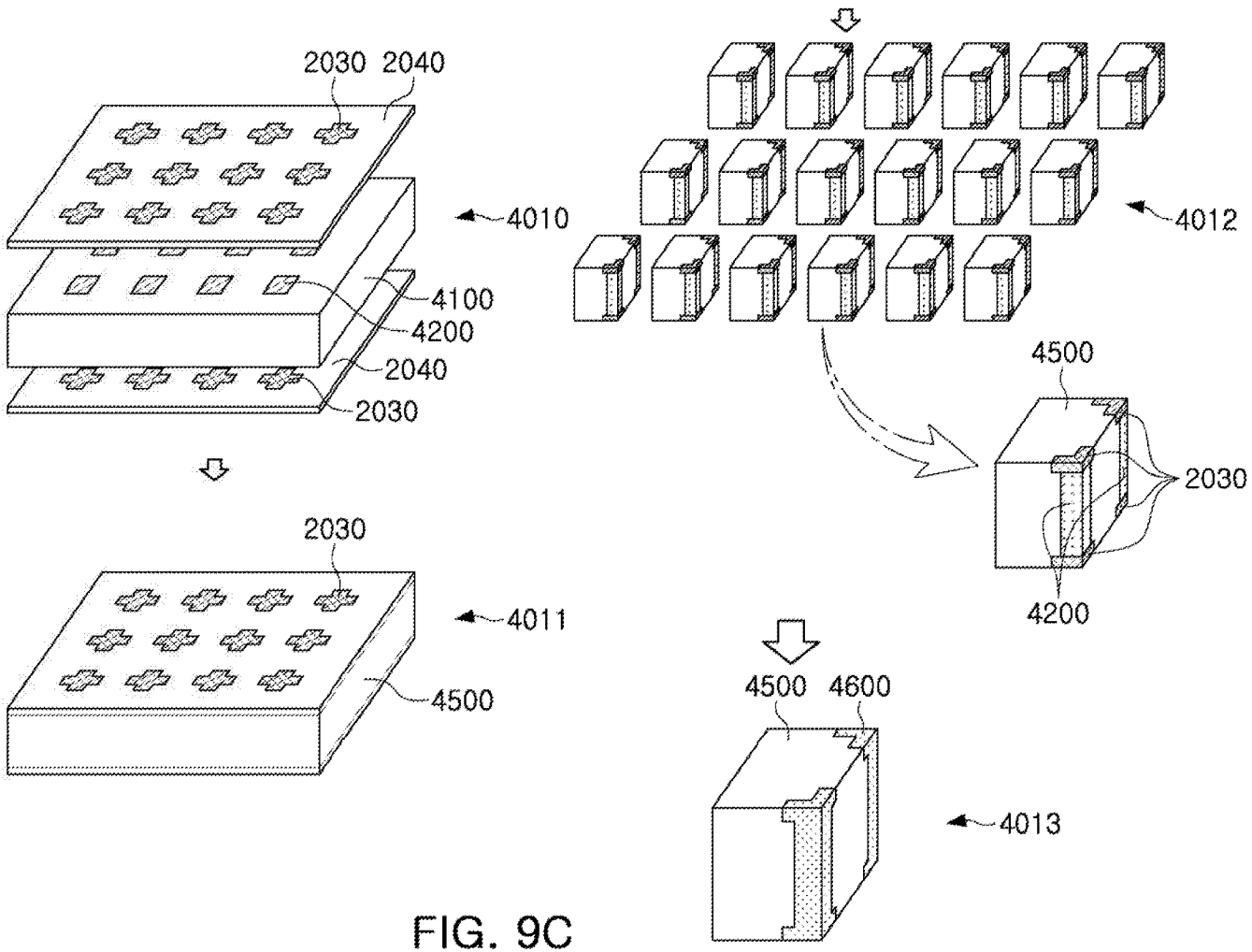

FIGS. 9A through 9C schematically illustrate another example of manufacturing processes of forming a laminate and manufacturing individual coil components using the laminate.

Referring to process 4001, photosensitive films 4020 may be stacked on a core substrate 4010 having a plurality of metal layers 4011 and 4012 formed on both surfaces thereof. The core substrate 4010 having the plurality of metal layers 4011 and 4020 may be a known copper clad laminate (CCL), for example, formed by attaching copper clad having a thickness of about 18 μm onto both surfaces of a polypropylene glycol (PPG) substrate and forming a seed copper (Cu) layer at a thickness of 5 μm through plating. The photosensitive film 4020 may be a known dry film photoresist (DFR) film. In this case, a thickness of the DFR film may be about 15 μm to 50 μm. The photosensitive films 4020 may be stacked under a roll lamination condition at a temperature of 120° C. and a pressure of 5 kgf/cm$^2$, but are not limited thereto.

Referring to process 4002, exposure and development 4021 and 4022 for forming conductor patterns 4023 and electrode patterns 4024 may be performed on the photosensitive films 4020 using a known photolithography method.

Referring to process 4003, a conductive material such as a copper (Cu), or the like, may be filled in holes formed by the exposure and the development using plating, or the like, to form the conductor patterns 4023 and the electrode patterns 4024, and the photosensitive films 4020 may be peeled off. The plating may be performed by a known plating method, a plating thickness may be 5 μm to 50 μm, and the metal layers 4012 may be used as seed layers.

Referring to process 4004, dielectric layers 4040 containing a photosensitive dielectric material may be stacked on the conductor patterns 4023 and the electrode patterns 4024. Via holes 4051 and 4052 exposing the conductor patterns 4023 and the electrode patterns 4024 may be formed in the dielectric layers 4040. The via holes 4051 and 4052 may be formed through exposure and development.

Referring to process 4005, a conductive material may be filled in the via holes 4051 and 4052 to form conductive vias 4061 and 4062 and electrode vias 4071 and 4072. The conductive vias 4061 and 4062 and the electrode vias 4071 and 4072 may be formed by a known metal plating process, conductive paste printing process, or the like. The conductive vias 4061 and 4062 and the electrode vias 4071 and 4072 may include, for example, copper conductor layers 4061 and 4071 and tin conductor layers 4062 and 4072, respectively, but are not limited thereto. The respective tin conductor layers 4062 and 4072 may have small step portions of about 5 μm from surfaces of respective dielectric layers 4040.

Referring to process 4006, mask films 4080 may be stacked on the dielectric layers 4040 in order to protect the conductor patterns 4023, the electrode patterns 4024, and the like. In addition, the core substrate 4010 may be peeled off by separating the plurality of metal layers 4011 and 4012 from each other.

Referring to process 4007, the metal layers 4012 may be removed by a known etching process. As a result, the dielectric layers 3040 in which the conductive vias 4061 and 4062, the electrode vias 4071 and 4072, the conductor patterns 4023, and the electrode patterns 4024 are formed may be formed.

Referring to process 4008, a plurality of dielectric layers 4040 in which the conductive vias 4061 and 4062, the electrode vias 4071 and 4072, the conductor patterns 4023, and the electrode patterns 4024 are formed through a series of processes and a plurality of dielectric cover layers 1020 in which electrode vias 1023 are formed may be stacked in a block so that the electrode vias 4071, 4072, and 1023 are connected to each other. The electrode vias 1023 of the dielectric cover layers 1020 may be formed by a known plating process, paste printing process, or the like, before the dielectric cover layers 1020 are stacked. Here, the conductive vias 4061 and 4062 and the electrode vias 4071 and 4072 may be formed of a metal oxide of copper (Cu)-tin (Sn).

Referring to process 4009, a laminate 4100 in which a plurality of electrode vias 4200 are formed may be formed as a result of stacking the plurality of dielectric layers 4040 and the plurality of dielectric cover layers 1020 in a block.

Referring to process 4010, the laminate 4100 and a plurality of pad dielectric layers 2040 on which electrode pads 2030 are formed may be stacked in a block so that the electrode vias 4200 of the laminate 4100 and the electrode pads 2030 of the plurality of pad dielectric layers 2040 are connected to each other.

Referring to process 4011, a laminate 4500 in which a plurality of electrode pads 2030 and conductor layers 4300 are formed may be formed as a result of stacking the laminate 4100 and the plurality of pad dielectric layers 2040 in a block. Here, the conductor layer 4300 may include the electrode vias 4071, 4072, and 1023, and the electrode patterns 4024.

Referring to process 4012, the laminate 4500 may be diced using a dicing blade, or the like, to form a plurality of individual bodies.

Referring to process 4013, conductor layers 4500 may be again formed on the electrode pads 2030 and the conductor layers 4300 of each of the plurality of individual bodies. As a result, external electrodes 4600 may be formed. The conductor layer 4500 may include a nickel (Ni) layer and a tin (Sn) layer. The conductor layer 3500 may be formed by forming the nickel (Ni) layer by plating and then forming the tin (Sn) layer by plating, but is not limited thereto.

Figure 10:
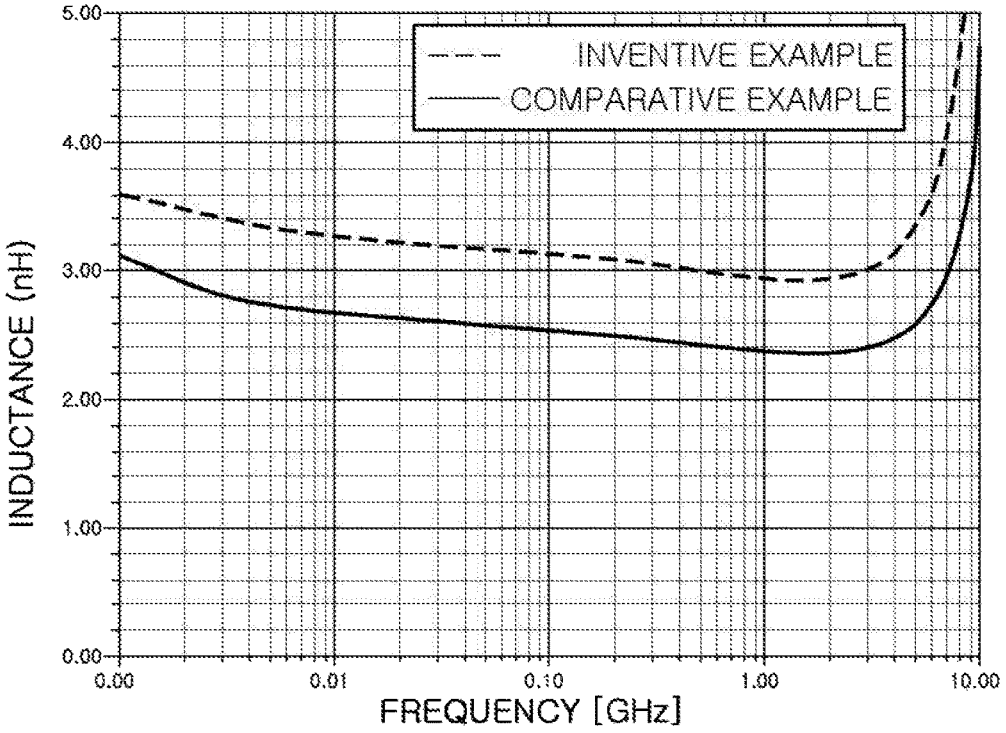
FIG. 10 is a graph comparing inductances of a coil component according to the related art (Comparative Example) and a coil component according to an exemplary embodiment in the present disclosure (Inventive Example) with each other.
Figure 11:
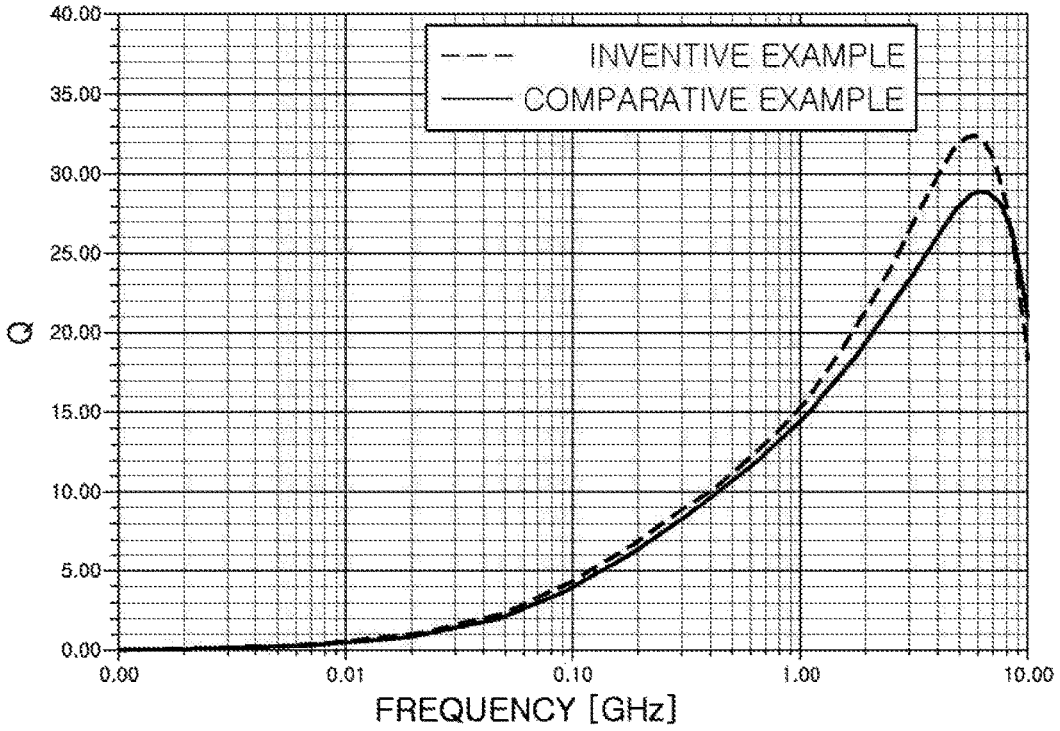
FIG. 11 is a graph comparing Q values of a coil component according to the related art (Comparative Example) and a coil component according to an exemplary embodiment in the present disclosure (Inventive Example) with each other.

FIG. 10 is a graph comparing inductances of a coil component according to the related art (Comparative Example) and a coil component according to an exemplary embodiment in the present disclosure (Inventive Example) with each other; and FIG. 11 is a graph comparing Q values of a coil component according to the related art (Comparative Example) and a coil component according to an exemplary embodiment in the present disclosure (Inventive Example) with each other.

A coil component according to the related art of FIGS. 10 and 11 corresponds to a coil component having external electrodes protruding outwardly of a body and having an L shaped structure.

Referring to FIGS. 10 and 11, it might be confirmed that inductance is increased by about 25% in Inventive Example as compared to Comparative Example and a Q factor is increased by about 10% in Inventive Example as compared to Comparative Example in a design in which areas of cores are the same as each other and the number of layers are the same as each other.

As set forth above, in the coil component according to an exemplary embodiment in the present disclosure, a volume of the body to an entire volume of the coil component may be significantly increased, such that inductance of the coil component may be excellent. In addition, a parasitic capacitance generated between the conductor patterns and the external electrodes may be decreased, such that a Q factor of the coil component may be excellent.

While exemplary embodiments have been shown and described above, it will be apparent to those skilled in the art that modifications and variations could be made without departing from the scope of the present invention as defined by the appended claims.

What is claimed is:

1. A coil component comprising:

a body including a plurality of dielectric layers that are stacked along a width direction and a plurality of conductor patterns formed on respective dielectric layers and connected to each other by conductive vias; and first and second external electrodes connected to end portions of the plurality of conductor patterns, respectively, wherein at least portions of the first and second external electrodes are recessed in the body, the first external electrode has an L shape in a length-thickness plane, is exposed from a first surface of the body, and extends to a second surface of the body, and the first external electrode includes side portions exposed from respective surfaces of the body in the width direction and a central portion directly connecting the side portions to each other in the width direction, the second external electrode has an L shape in the length-thickness plane, is exposed from the first surface of the body, and extends to a third surface of the body opposing the second surface in a length direction, and the second external electrode includes side portions exposed from the respective surfaces of the body in the width direction and a central portion directly connecting the side portions thereof to each other in the width direction, and in the length direction, the side portions of the first external electrode exposed from the first surface have a length longer than a uniform length of the central portion of the first external electrode exposed from the first surface.

2. The coil component of claim 1, wherein exterior surfaces of the first and second external electrodes are coplanar with surfaces of the body.

3. The coil component of claim 1, wherein the end portions of the plurality of conductor patterns include first and second end portions respectively exposed to positions spaced apart from each other on the first surface of the body, and portions of the first and second external electrodes formed on the first surface of the body are spaced apart from each other and respectively connected to the first and second end portions.

4. The coil component of claim 3, wherein the first surface of the body is a mounting surface of the coil component.

5. The coil component of claim 1, wherein conductor patterns are not formed on dielectric layers directly contacting the side portions of the first and second external electrodes.

6. The coil component of claim 1, wherein a distance in the thickness direction from the central portions of the first and second external electrodes formed on the second surface or the third surface of the body to the first surface of the body is shorter than a distance in the thickness direction from portions of the plurality of conductor patterns except both end portions of the plurality of conductor patterns to the first surface of the body.

7. The coil component of claim 1, wherein the dielectric layer contains a photosensitive dielectric material.

8. The coil component of claim 1, wherein the conductor patterns are formed in a loop shape along circumferences of the dielectric layers.

* * * * *